US010373553B2

(12) United States Patent
Shin

(10) Patent No.: US 10,373,553 B2
(45) Date of Patent: Aug. 6, 2019

(54) ORGANIC LIGHT EMITTING DIODE DISPLAY DEVICE AND METHOD OF DRIVING THE SAME

(71) Applicant: SAMSUNG DISPLAY CO., LTD., Yongin-si, Gyeonggi-do (KR)

(72) Inventor: Jeonghwan Shin, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 15/821,521

(22) Filed: Nov. 22, 2017

(65) Prior Publication Data

US 2018/0144683 A1 May 24, 2018

(30) Foreign Application Priority Data

Nov. 23, 2016 (KR) ..... 10-2016-0156627

(51) Int. Cl.

| | |
|---|---|
| ***G09G 3/3225*** | (2016.01) |
| ***G09G 3/3233*** | (2016.01) |
| *G09G 3/3266* | (2016.01) |
| *G09G 3/3275* | (2016.01) |

(52) U.S. Cl.

CPC ..... *G09G 3/3225* (2013.01); *G09G 3/3233* (2013.01); *G09G 3/3266* (2013.01); *G09G 3/3275* (2013.01); *G09G 2300/0426* (2013.01); *G09G 2300/0842* (2013.01); *G09G 2300/0861* (2013.01); *G09G 2310/0262* (2013.01); *G09G 2310/0291* (2013.01); *G09G 2310/08* (2013.01); *G09G 2320/029* (2013.01);

(Continued)

(58) Field of Classification Search

CPC ..... G09G 3/3225; G09G 3/3266

See application file for complete search history.

(56) References Cited

U.S. PATENT DOCUMENTS

| | | | | |
|---|---|---|---|---|
| 8,564,510 | B2 | 10/2013 | Min et al. | |
| 2012/0019569 | A1* | 1/2012 | Byun | G09G 3/3233 345/690 |

(Continued)

FOREIGN PATENT DOCUMENTS

| | | |
|---|---|---|
| KR | 10-2014-0137218 | 12/2014 |
| KR | 10-2016-0083613 | 7/2016 |
| KR | 10-1634286 | 7/2016 |

*Primary Examiner* — Alexander Eisen

*Assistant Examiner* — Mansour Said

(74) *Attorney, Agent, or Firm* — Lewis Roca Rothgerber Christie LLP

(57) ABSTRACT

An organic light emitting diode display device including a display panel including a pixel, a power supply configured to apply a voltage to the pixel, and a current measurement circuit connected to the pixel, wherein the pixel includes a pixel circuit and an organic light emitting diode, the pixel circuit including a plurality of switching elements and one or more capacitors, and wherein the current measurement circuit includes a current integration circuit including an amplifier, the amplifier including a first input terminal, a second input terminal, and an output terminal, the first input terminal being connected to the pixel circuit, a threshold voltage compensation circuit connected to the second input terminal of the amplifier, and an analog-to-digital converter connected to the output terminal of the amplifier.

13 Claims, 11 Drawing Sheets

(52) U.S. Cl.
CPC . *G09G 2320/043* (2013.01); *G09G 2320/045* (2013.01); *G09G 2330/021* (2013.01)

(56) References Cited

U.S. PATENT DOCUMENTS

| | | | | |
|---|---|---|---|---|
| 2014/0198092 | A1* | 7/2014 | Azizi | G09G 3/006 345/212 |
| 2014/0347332 | A1 | 11/2014 | Lee | |
| 2016/0163262 | A1 | 6/2016 | Azizi et al. | |
| 2018/0114815 | A1* | 4/2018 | Lee | G06K 9/00013 |

* cited by examiner

ORGANIC LIGHT EMITTING DIODE DISPLAY DEVICE AND METHOD OF DRIVING THE SAME

CROSS-REFERENCE TO RELATED APPLICATION

This application claims priority to and the benefit of Korean Patent Application No. 10-2016-0156627, filed on Nov. 23, 2016, in the Korean Intellectual Property Office (KIPO), the disclosure of which is incorporated by reference herein in its entirety.

BACKGROUND

1. Field

Aspects of the present invention relate to an organic light emitting diode ("OLED") display device capable of improving image quality degradation and a method of driving the OLED display device.

2. Discussion of Related Art

In recent times, various flat panel display ("FPD") devices are being developed that may reduce the weight and volume, which are disadvantages of cathode ray tubes ("CRT"). Examples of the FPD device may include liquid crystal display ("LCD") devices, field emission display ("FED") devices, plasma display panel ("PDP") devices, OLED display devices, and the like.

Among the FPD devices, the OLED display device displays an image using OLEDs, which generate light by recombination of electrons and holes.

It is to be understood that this background of the technology section is intended to provide useful background for understanding the technology and as such, the technology background section may include ideas, concepts, or recognitions that were not part of what was known or appreciated by those skilled in the pertinent art prior to a corresponding effective filing date of subject matter disclosed herein.

SUMMARY

Aspects of embodiments of the present invention are directed to an OLED display device capable of improving image quality degradation and a method of driving the OLED display device.

According to some embodiments, there is provided an organic light emitting diode display device including: a display panel including a pixel; a power supply configured to apply a voltage to the pixel; and a current measurement circuit connected to the pixel, wherein the pixel includes a pixel circuit and an organic light emitting diode, the pixel circuit including a plurality of switching elements and one or more capacitors, and wherein the current measurement circuit includes: a current integration circuit including an amplifier, the amplifier including a first input terminal, a second input terminal, and an output terminal, the first input terminal being connected to the pixel circuit; a threshold voltage compensation circuit connected to the second input terminal of the amplifier; and an analog-to-digital converter connected to the output terminal of the amplifier.

In some embodiments, the threshold voltage compensation circuit includes a plurality of switches and a threshold voltage storage capacitor configured to selectively apply a reference voltage and a sum of the reference voltage and a threshold voltage of the organic light emitting diode to the second input terminal of the amplifier.

In some embodiments, the power supply is configured to supply the reference voltage, and the threshold voltage compensation circuit is connected to the power supply.

In some embodiments, the threshold voltage compensation circuit is connected to a ground potential source.

In some embodiments, the plurality of switches of the threshold voltage compensation circuit include a first switch, a second switch, a third switch, a fourth switch, a fifth switch, and a sixth switch, one end of the second switch is connected to the organic light emitting diode and another end of the second switch is connected to the third switch, the threshold voltage storage capacitor, and the fifth switch, one end of the third switch is connected to the second switch, the threshold voltage storage capacitor, and the fifth switch, and another end of the third switch is connected to the current integration circuit, one end of the fourth switch is connected to the threshold voltage storage capacitor, the fifth switch, and the sixth switch, and another end of the fourth switch is connected to the ground potential source, one end of the fifth switch is connected to the second switch, the third switch, and the threshold voltage storage capacitor, and another end of the fifth switch is connected to the fourth switch and the sixth switch, one end of the sixth switch is connected to the fourth switch and the fifth switch, and another end of the sixth switch is connected to the power supply, and one end of the threshold voltage storage capacitor is connected to the second switch, the third switch, and the fifth switch, and another end of the threshold voltage storage is connected to the fourth switch, the fifth switch, and the sixth switch.

In some embodiments, the current integration circuit further includes: a feedback capacitor connected to the first input terminal and the output terminal of the amplifier; and a feedback switch connected in parallel with the feedback capacitor between the first input terminal and the output terminal of the amplifier.

In some embodiments, the analog-to-digital converter is connected to the feedback capacitor and the feedback switch of the current integration circuit.

According to some embodiments, there is provided an method of driving an organic light emitting diode display device, the method including: initializing a threshold voltage compensation circuit and a current integration circuit connected to the threshold voltage compensation circuit; storing a threshold voltage of an organic light emitting diode in the threshold voltage compensation circuit; and measuring a driving current of the organic light emitting diode by compensating a reference voltage with the stored threshold voltage of the organic light emitting diode.

In some embodiments, the initializing the threshold voltage compensation circuit includes applying the reference voltage to the threshold voltage compensation circuit.

In some embodiments, the threshold voltage compensation circuit includes a threshold voltage storage capacitor.

In some embodiments, the storing the threshold voltage of the organic light emitting diode in the threshold voltage compensation circuit includes applying a threshold voltage of the organic light emitting diode to the threshold voltage storage capacitor of the threshold voltage compensation circuit.

In some embodiments, the measuring the driving current of the organic light emitting diode includes: applying a sum of the reference voltage and the threshold voltage to the threshold voltage compensation circuit and the organic light emitting diode; and applying a current corresponding to the sum of the reference voltage and the threshold voltage through the current integration circuit and the organic light emitting diode.

In some embodiments, the reference voltage has a value greater than a value of the threshold voltage.

The foregoing is illustrative only and is not intended to be in any way limiting. In addition to the illustrative aspects, embodiments and features described above, further aspects, embodiments and features will become apparent by reference to the drawings and the following detailed description.

BRIEF DESCRIPTION OF THE DRAWINGS

A more complete appreciation according to an embodiment will become more apparent by describing in detail embodiments thereof with reference to the accompanying drawings, wherein.

DETAILED DESCRIPTION

Figure 1:
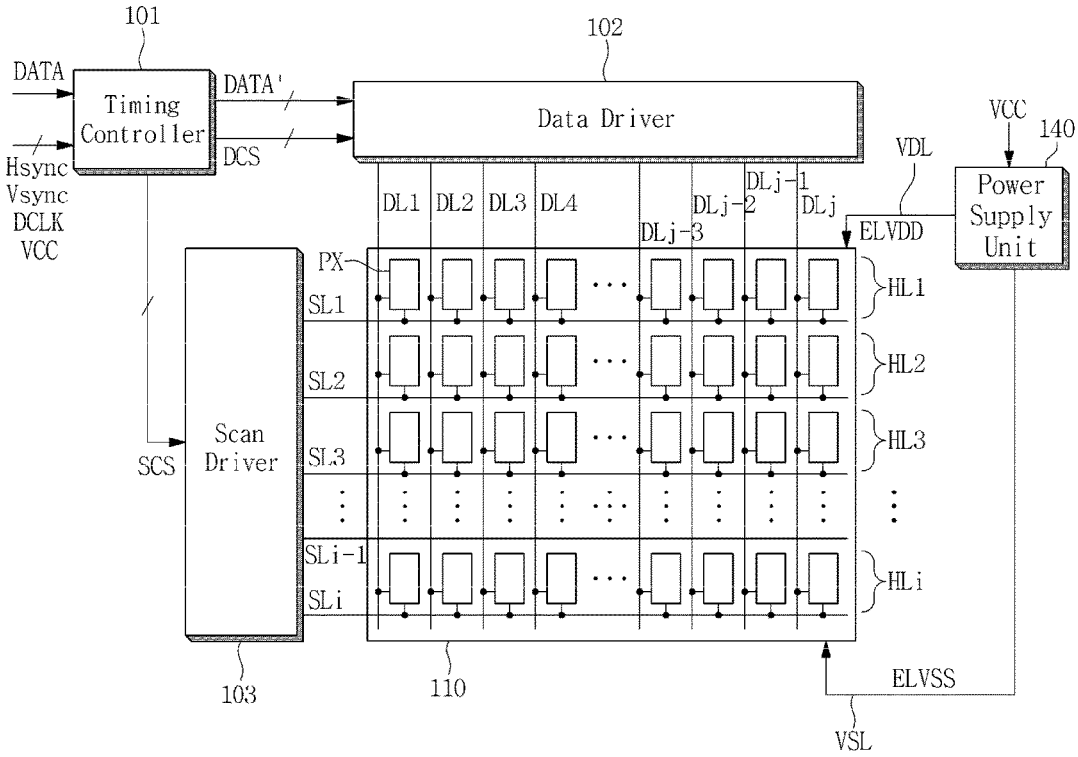
FIG. 1 is a block diagram illustrating an OLED display device according to an exemplary embodiment of the present invention.

Embodiments will now be described more fully hereinafter with reference to the accompanying drawings. Although the invention may be modified in various suitable ways and has several embodiments, embodiments are illustrated in the accompanying drawings and will be mainly described in the specification. However, the scope of the invention is not limited to the described embodiments and should be construed as including all the changes, equivalents, and substitutions included in the spirit and scope of the invention.

In the drawings, thicknesses of a plurality of layers and areas are illustrated in an enlarged manner for clarity and ease of description thereof.

Unless otherwise defined, all terms used herein (including technical and scientific terms) have the same meaning as commonly understood by those skilled in the art to which this invention pertains. It will be further understood that terms, such as those defined in commonly used dictionaries, should be interpreted as having a meaning that is consistent with their meaning in the context of the relevant art and will not be interpreted in an ideal or excessively formal sense unless clearly defined in the present specification.

FIG. 1 is a block diagram illustrating an OLED display device according to an exemplary embodiment of the present invention.

As illustrated in FIG. 1, the display device includes a display panel 110, a timing controller 101, a scan driver 103, a data driver 102 and a power supply unit (e.g., a power supply) 140.

The display panel 110 includes i number of scan lines SL1 to SLi, j number of data lines DL1 to DLj, i*j number of pixels PX, a high electric potential power line VDL and a low electric potential power line VSL, where each of i and j is a natural number greater than 1.

First to i-th scan signals are applied to first to i-th scan lines SL1 to SLi and first to j-th data voltages are applied to first to j-th data lines DL1 to DLj.

The pixels PX are arranged at the display panel 110 in a form of a matrix. The pixels PX may include red pixels emitting red light, green pixels emitting green light, blue pixels emitting blue light, and white pixels emitting white light.

The red pixel, the green pixel, the blue pixel, and the white pixel adjacent to each other in a horizontal direction may form a unit pixel for displaying one unit of an image (or one image unit).

In an exemplary embodiment, j number of pixels arranged along an n-th horizontal line (hereinafter, n-th horizontal line pixels) are individually connected to the first to j-th data lines DL1 to DLj, respectively. In addition, the n-th horizontal line pixels are connected in common to an n-th scan line, wherein n is number selected from 1 to i.

The n-th horizontal line pixels receive an n-th scan signal as a common signal. That is, all of j number of pixels in a substantially same horizontal line receive a substantially same scan signal, while pixels in different horizontal lines receive different scan signals. For example, pixels in a first horizontal line HL1 all receive a first scan signal, while pixels in a second horizontal line HL2 all receive a second scan signal that is output later in time than the first scan signal.

Each pixel PX receives a high electric potential driving voltage ELVDD and a low electric potential driving voltage ELVSS through the high electric potential power line VDL and the low electric potential power line VSL, respectively.

As illustrated in FIG. 1, the timing controller 101 receives a vertical synchronization signal Vsync, a horizontal synchronization signal Hsync, an image data signal DATA, and a reference clock signal DCLK, which are output from a graphic controller provided in a system, which is a part of, or is external to and in communication with, the OLED display device according to some embodiments of the present invention.

An interface circuit is provided between the timing controller 101 and the system, and the aforementioned signals output from the system are input to the timing controller 101 through the interface circuit. The interface circuit may be embedded in the timing controller 101.

The interface circuit may include a low voltage differential signaling (LVDS) receiver. The interface circuit lowers voltage levels of the vertical synchronization signal Vsync, the horizontal synchronization signal Hsync, the image data signals DATA, and the reference clock signal DCLK output from the system, while raising frequencies thereof.

In an exemplary embodiment, electromagnetic interference (EMI) may occur due to high frequency components of a signal input from the interface circuit to the timing controller 101. In order to reduce or substantially eliminate the EMI, an EMI filter may be further provided between the interface circuit and the timing controller 101.

The timing controller 101 generates a scan control signal SCS for controlling the scan driver 103 and a data control signal DCS for controlling the data driver 102, using the vertical synchronization signal Vsync, the horizontal synchronization signal Hsync, and the reference clock signal DCLK.

The scan control signal SCS includes a gate start pulse, a gate shift clock, a gate output enable signal, and the like.

The data control signal DCS includes a source start pulse, a source shift clock, a source output enable signal, and the like.

In addition, the timing controller 101 rearranges the image data signals DATA input through the system and applies the rearranged image data signals DATA' to the data driver 102.

In an exemplary embodiment, the timing controller 101 is operated by (e.g., powered by) a driving power VCC output from a power unit (e.g., a power source) provided in the system. For example, the driving power VCC may be used as a power voltage of a phase lock loop ("PLL") circuit embedded in the timing controller 101.

The PLL circuit compares a reference clock signal DCLK input to the timing controller 101 with a reference frequency generated from an oscillator. Then, in the case where it is identified from the comparison that there is a difference between them, the PPL circuit adjusts the frequency of the reference clock signal DCLK by the difference to generate a sampling clock signal. This sampling clock signal is a signal for sampling the image data signals DATA'.

The power supply unit 140 increases or decreases the driving power VCC input through the system to generate various suitable voltages utilized by the display panel 110. The power supply unit 140 may be a DC-DC converter.

The power supply unit 140 may include, for example, an output switching element for switching an output voltage of an output terminal thereof and a pulse width modulator PWM for adjusting a duty ratio or a frequency of a control signal applied to a control terminal of the output switching element so as to increase or decrease the output voltage. In some examples, the power supply unit 140 may include a pulse frequency modulator PFM, instead of the pulse width modulator PWM.

The pulse width modulator PWM may increase the duty ratio of the aforementioned control signal to raise the output voltage of the power supply unit 140 or may decrease the duty ratio of the control signal to lower the output voltage of the power supply unit 140. The pulse frequency modulator PFM may increase the frequency of the aforementioned control signal to raise the output voltage of the power supply unit 140 or may decrease the frequency of the control signal to lower the output voltage of the power supply unit 140.

The output voltage of the power supply unit 140 may include the high electric potential driving voltage ELVDD and the low electric potential driving voltage ELVSS. In addition, the output voltage of the power supply unit 140 may further include a reference voltage, gamma reference voltages, a gate high voltage, a gate low voltage, and/or the like.

The gamma reference voltages are voltages generated by voltage division of the reference voltage. The gamma reference voltages are analog voltages, which are applied to the data driver 102.

The high electric potential driving voltage ELVDD and the low electric potential driving voltage ELVSS output from the power supply unit 140 are applied to the display panel 110. For example, the high electric potential driving voltage ELVDD is applied to the pixels PX of the display panel 110 through the high electric potential power line VDL and the low electric potential driving voltage ELVSS is applied to the pixels of the display panel 110 through the low electric potential power line VSL.

The gate high voltage is a high logic voltage of a gate signal set to be equal to or higher than a threshold voltage of a data transmission thin film transistor ("TFT") T2 (see, e.g., FIG. 2) and the gate low voltage is a low logic voltage of the gate signal set to be an off voltage of the data transmission TFT T2. The gate high voltage and the gate low voltage are applied to the scan driver 103.

The scan driver 103 generates scan signals according to the scan control signal SCS provided from the timing controller 101 and sequentially applies the scan signals to the plurality of scan lines SL1 to SLi.

The scan driver 103 may include, for example, a shift register that shifts the gate start pulse according to the gate shift clock to generate scan signals. The shift register may include a plurality of switching elements. The switching elements may be formed at a non-display area of the display panel 110 through a process substantially the same as a process through which a driving TFT T1 (see, e.g., FIG. 2) and the data transmission TFT T2 (see, e.g., FIG. 2) at a display area of the display panel 110 are formed.

The data driver 102 receives the image data signals DATA' and the data control signals DCS from the timing controller 101. The data driver 102 samples the image data signals DATA' according to the data control signal DCS, sequentially latches the sampling image data signals corresponding to one horizontal line in each horizontal period and concurrently (e.g., substantially simultaneously) applies the latched image data signals to the data lines DL1 to DLj.

For example, the data driver 102 converts the image data signals DATA' applied from the timing controller 101 into analog image data signals using the gamma reference voltages input from the power supply unit 140 and applies the analog image data signals to the data lines DL1 to DLj.

The data driver 102 may include a gray level generator, which generates a plurality of gray level voltages using the gamma reference voltages applied from the power supply unit 140. The data driver 102 converts the image data signals DATA' applied from the timing controller 101 into analog signals using the gray level voltages.

In an exemplary embodiment, the gray level generator may be located inside or outside the data driver 102.

However, exemplary embodiments are not limited thereto. In an exemplary embodiment, an initialization voltage line VL (see, e.g., FIG. 2) for transmitting an initializing voltage VINT (see, e.g., FIG. 2), an emission control line ELn (see, e.g., FIG. 2) for transmitting an emission control signal En (see, e.g., FIG. 2), and a current sensing control line CSCSLn (see, e.g., FIG. 2) for transmitting a current sensing control signal CSCSn (see, e.g., FIG. 2) may be further provided.

Figure 2:
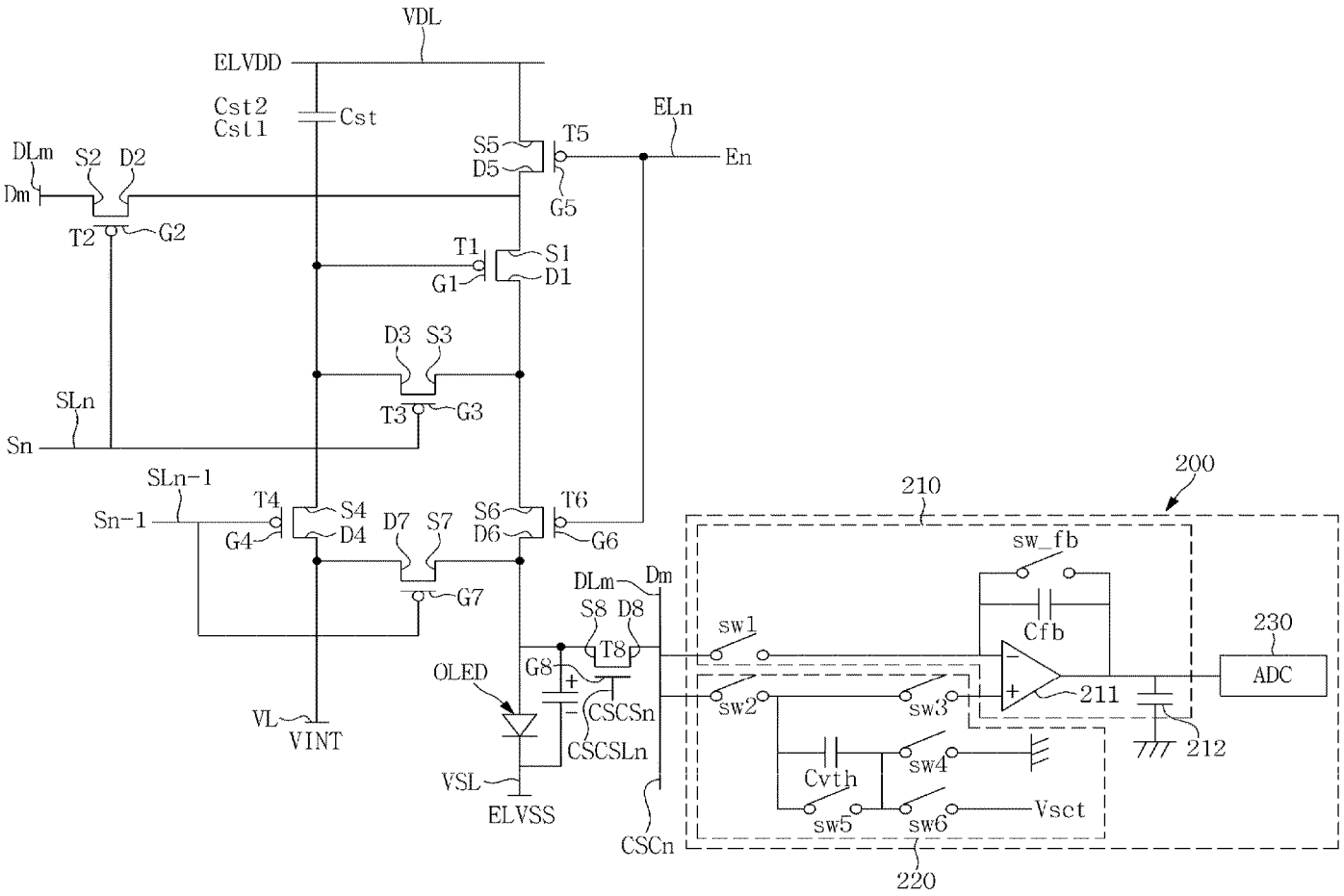
FIG. 2 is a detailed configuration view illustrating a pixel and a current measurement unit illustrated in FIG. 1.

FIG. 2 is a detailed configuration view illustrating a pixel and a current measurement unit according to an exemplary embodiment.

Each pixel PX includes an OLED for emitting light, and a pixel circuit for receiving a signal from a wiring and driving the OLED. FIG. 2 illustrates an active matrix-type organic light emitting diode (AMOLED) display device having a 7Tr-1C structure. For example, the 7Tr-1C structure may include seven TFTs and one capacitor in each pixel, but exemplary embodiments are not limited thereto. For example, the pixel circuit may include at least two TFTs and at least one capacitor, and may have various suitable structures by further including additional wirings or omitting existing wirings.

A TFT includes a driving TFT T1, a data transmission TFT T2, a compensation TFT T3, a first initialization TFT T4, a first emission control TFT T5, a second emission control TFT T6, a second initialization TFT T7, and a current measurement TFT T8.

A gate electrode G1 of the driving TFT T1 is connected to a lower electrode Cst1 of a capacitor Cst, a source electrode S1 of the driving TFT T1 is connected to the high electric potential power line VDL via the first emission control TFT T5, and a drain electrode D1 of the driving TFT T1 is connected to a pixel electrode of the OLED via the second emission control TFT T6. The driving TFT T1 receives a data signal Dm according to a switching operation of the data transmission TFT T2 and applies a driving current Iel to the OLED.

A gate electrode G2 of the data transmission TFT T2 is connected to a scan line SLn, a source electrode S2 of the data transmission TFT T2 is connected to a data line DLm, and a drain electrode D2 of the data transmission TFT T2 is connected to the source electrode S1 of the driving TFT T1 and further connected to the high electric potential power line VLD via the first emission control TFT T5. The data transmission TFT T2 is turned on according to a scan signal Sn transmitted through the scan line SLn to perform a switching operation to transmit the data signal Dm, applied to the data line DLm, to the source electrode S1 of the driving TFT T1.

A gate electrode G3 of the compensation TFT T3 is connected to the scan line SLn, and a source electrode S3 of the compensation TFT T3 is connected to the drain electrode D1 of the driving TFT T1 and further connected to the pixel electrode of the OLED via the second emission control TFT T6. A drain electrode D3 of the compensation TFT T3 is connected to the lower electrode Cst1 of the capacitor Cst1, a source electrode S4 of the first initialization TFT T4, and the gate electrode G1 of the driving TFT T1. Such a compensation TFT T3 is turned on according to the scan signal Sn transmitted through the scan line SLn to connect the gate electrode G1 and the drain electrode D1 of the driving TFT T1 to each other, thereby diode-connecting the driving TFT T1. However, exemplary embodiments are not limited thereto, and the compensation TFT T3 may include two or more TFTs connected in series.

A gate electrode G4 of the first initialization TFT T4 is connected to a previous scan line SLn−1 and a drain electrode D4 of the first initialization TFT T4 is connected to the initialization voltage line VL. The source electrode S4 of the first initialization TFT T4 is connected to the lower electrode Cst1 of the capacitor Cst, the drain electrode D3 of the compensation TFT T3, and the gate electrode G1 of the driving TFT T1. The first initialization TFT T4 is turned on according to a previous scan signal Sn−1 transmitted through the previous scan line SLn−1 to transmit the initialization voltage VINT to the gate electrode G1 of the driving TFT T1 and perform an initializing operation for initializing the voltage of the gate electrode G1 of the driving TFT T1. However, exemplary embodiments are not limited thereto and the first initialization TFT T4 may include two or more TFTs connected in series.

Although it is illustrated in an exemplary embodiment that the first initialization TFT T4 is connected to the previous scan line SLn−1, exemplary embodiments are not limited thereto.

A gate electrode G5 of the first emission control TFT T5 is connected to the emission control line ELn. A source electrode S5 of the first emission control TFT T5 is connected to the high electric potential power line VDL, and a drain electrode D5 of the first emission control TFT T5 is connected to the source electrode S1 of the driving TFT T1 and the drain electrode S2 of the data transmission TFT T2. The first emission control TFT T5 is located between the high electric potential power line VDL and the driving TFT T1. The first emission control TFT T5 is turned on according to the emission control signal En transmitted through the emission control line ELn to transmit the high electric potential driving voltage ELVDD to the driving TFT T1.

A gate electrode G6 of the second emission control TFT T6 is connected to the emission control line ELn and a source electrode S6 of the second emission control TFT T6 is connected to the drain electrode D1 of the driving TFT T1 and the source electrode S3 of the compensation TFT T3. The drain electrode D6 of the second emission control TFT T6 is electrically connected to the pixel electrode of the OLED. The first emission control TFT T5 and the second emission control TFT T6 are turned on concurrently (e.g., substantially simultaneously) according to the emission control signal En received through the emission control line ELn, and the high electric potential driving voltage ELVDD is transmitted to the OLED, such that the driving current Iel may flow through the OLED.

A gate electrode G7 of the second initialization TFT T7 is connected to the previous scan line SLn−1. A source electrode S7 of the second initialization TFT T7 is connected to the pixel electrode of the OLED. A drain electrode D7 of the second initialization TFT T7 is connected to the initialization voltage line VL. The second initialization TFT T7 is turned on according to the scan signal Sn transmitted through the previous scan line SLn−1 to initialize the pixel electrode of the OLED.

An upper electrode Cst2 of the capacitor Cst is connected to the high electric potential power line VDL, and a common electrode of the OLED is connected to the low electric potential power line VSL. Accordingly, the OLED receives the driving current Iel from the driving TFT T1 and emits light, thereby displaying an image.

A gate electrode G8 of the current measurement TFT T8 is connected to a current measurement control line CSCSLn, and a source electrode S8 of the current measurement TFT T8 is connected to the pixel electrode of the OLED. A drain electrode D8 of the current measurement TFT T8 is connected to the data line DLm. The current measurement TFT T8 is turned on according to the current measurement control signal CSCSn, transmitted through the current measurement control line CSCSLn, to connect a current measurement unit (e.g., a current measurement circuit) 200 and the OLED. However, exemplary embodiments are not limited thereto, and the current measurement TFT T8 may include two or more TFTs connected in series.

The current measurement unit 200 includes a current integration circuit 210, a threshold voltage compensation circuit 220 and an analog-to-digital converter (ADC) 230. The current measurement unit 200 is connected to the OLED. Accordingly, the driving current Iel flowing through the OLED may be measured.

The current integration circuit 210 is a circuit for measuring an amount of current flowing in the circuit and includes an operational amplifier 211, a first switch sw1, a feedback switch sw_fb, and a feedback capacitor Cfb, as illustrated in FIG. 2.

The operational amplifier 211 may include a first input terminal (−), a second input terminal (+) and an output terminal. In such an exemplary embodiment, the first input terminal (−) may be an inverting input terminal and the second input terminal (+) may be a non-inverting input terminal. According to an exemplary embodiment, the threshold voltage compensation circuit 220 may be connected to the second input terminal (+) of the operational amplifier 211.

The first switch sw1 may be connected between the first input terminal (−) of the operational amplifier 211 and the current measurement control line CSCSLn connected to the data line DLm to perform a switching operation.

One end of the feedback capacitor Cfb may be connected to the first input terminal (−) of the operational amplifier 211 and another end of the feedback capacitor Cfb may be connected to the output terminal of the operational amplifier 211.

One end of the feedback switch sw_fb may be connected to the first input terminal (−) of the operational amplifier 211, and another end of the feedback switch sw_fb is connected to the output terminal of the operational amplifier 211 to be connected in parallel with the feedback capacitor Cfb. Accordingly, the feedback switch sw_fb may perform a switching operation.

As illustrated in FIG. 2, the current integration circuit 210 may further include a parasitic capacitor 212.

The threshold voltage compensation circuit 220 may include a plurality of switches sw2, sw3, sw4, sw5, and sw6, and a threshold voltage storage capacitor Cvth to selectively apply a sum of a reference voltage Vset and a threshold voltage Vth.

One end of a second switch sw2 is connected to the OLED and another end of the second switch sw2 is connected to a third switch sw3, the threshold voltage storage capacitor Cvth and a fifth switch sw5; one end of the third switch sw3 is connected to the second switch sw2, the threshold voltage storage capacitor Cvth, and the fifth switch sw5, and another end of the third switch sw3 is connected to the current integration circuit 210; one end of a fourth switch sw4 is connected to the threshold voltage storage capacitor Cvth, the fifth switch sw5, and a sixth switch sw6, and another end of the fourth switch sw4 is connected to a ground potential; one end of the fifth switch sw5 is connected to the second switch sw2, the third switch sw3, and the threshold voltage storage capacitor Cvth, and another end of the fifth switch sw5 is connected to the fourth switch sw4 and the sixth switch sw6; one end of the sixth switch sw6 is connected to the fourth switch sw4 and the fifth switch sw5, and another end of the sixth switch sw6 is connected to the power supply unit 140 applying the reference voltage Vset; and one end of the threshold voltage storage capacitor Cvth is connected to the second switch sw2, the third switch sw3, and the fifth switch sw5, and another end of the threshold voltage storage capacitor Cvth is connected to the fourth switch sw4, the fifth switch sw5, and the sixth switch sw6.

The analog-to-digital converter 230 may convert a signal output from the current integration circuit 210 into a digital signal and provide the converted signal to the timing controller 101. The analog-to-digital converter 230 is connected to the output terminal of the operational amplifier 211 and is connected to the feedback capacitor Cfb and the feedback switch sw_fb of the current integration circuit 210.

Figure 3:
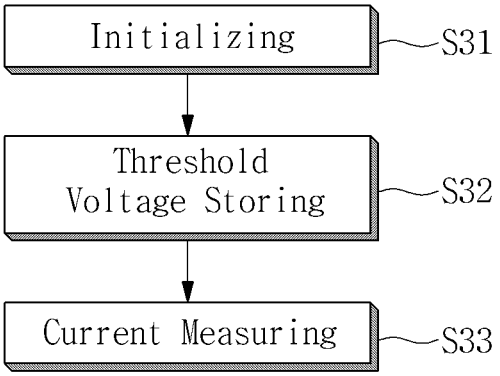
FIG. 3 is a flow diagram illustrating a sequence of driving a pixel illustrated in FIG. 1.
Figure 4:
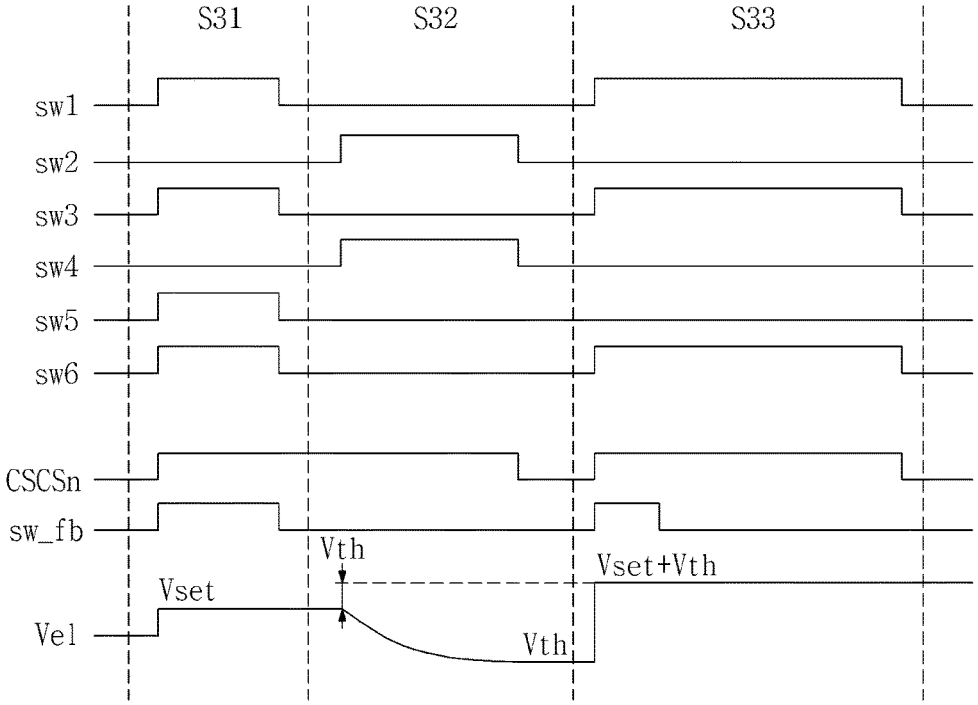
FIG. 4 is a timing diagram illustrating a driving of a pixel illustrated in FIG. 1.
Figure 5A:
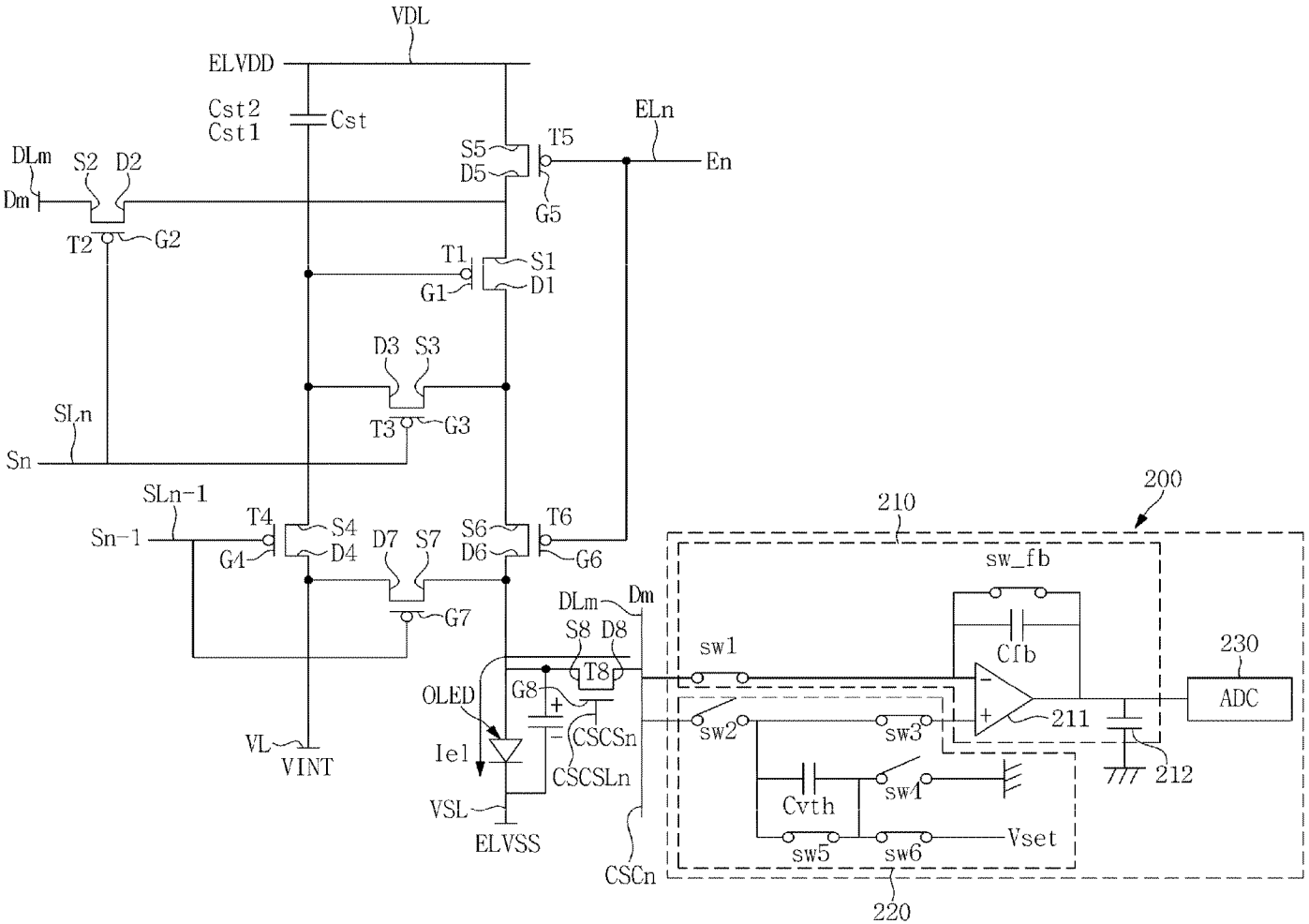
FIGS. 5A-5C are circuit diagrams illustrating a pixel and a current measurement unit according to each driving process.
Figure 5B:
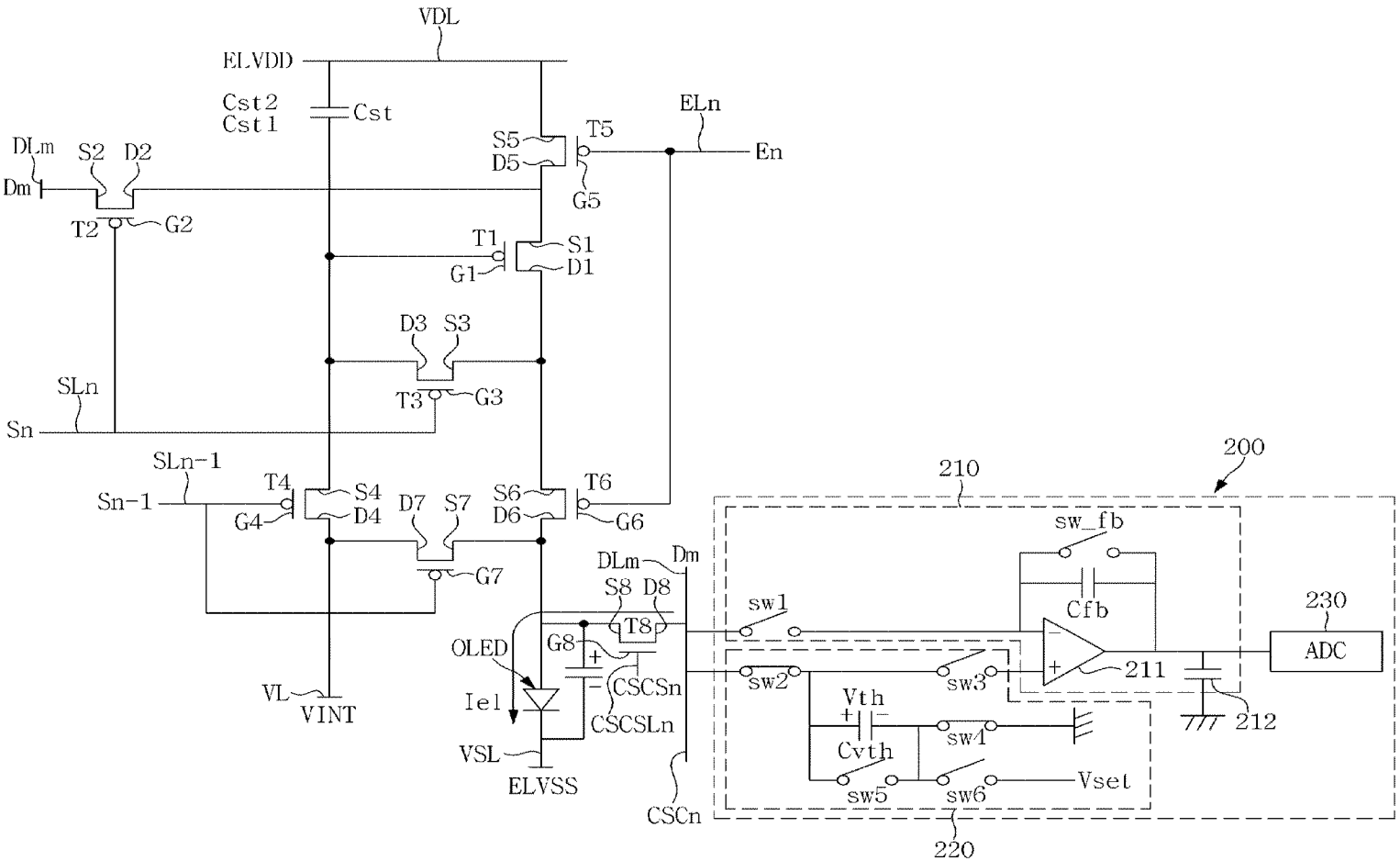
Figure 5C:
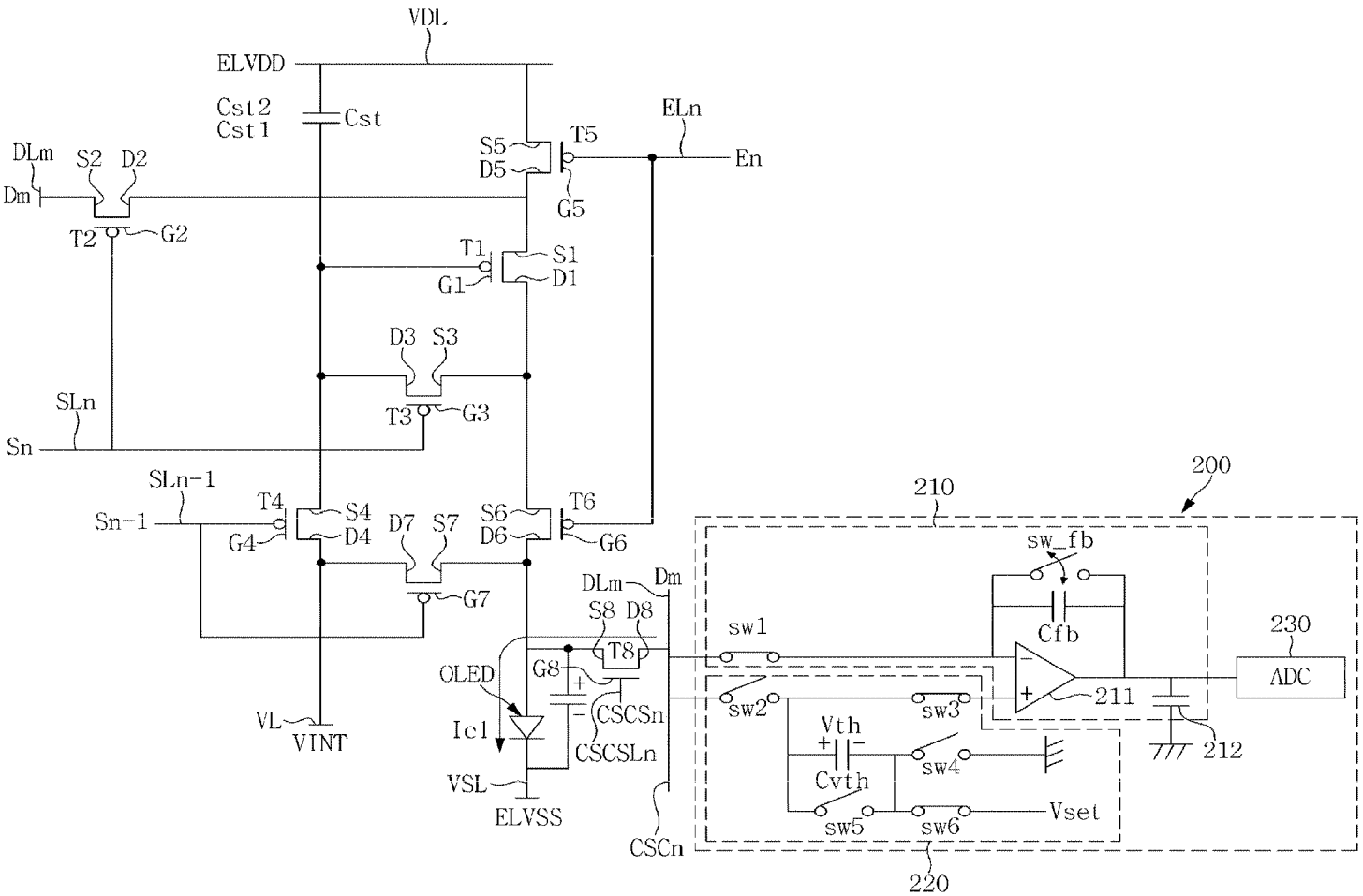

Hereinafter, an operation of the current measurement unit 200 will be described in detail with reference to FIGS. 3, 4, 5A, 5B, and 5C. FIG. 3 is a flow diagram illustrating a sequence of driving the pixel illustrated in FIG. 1. FIG. 4 is a timing diagram illustrating a driving of the pixel illustrated in FIG. 1. FIGS. 5A, 5B and 5C are circuit diagrams illustrating a pixel and a current measurement unit 200 according to each driving process.

The current measurement unit 200 measures a driving current Iel flowing through the OLED in order to calculate current-voltage characteristics of the OLED, and may be activated when an entire power source of the OLED display device is turned off or turned on. As an example, the current measurement unit 200 may be activated in an inspection mode in which the entire power source of the OLED display device is turned off. As another example, the current measurement unit 200 may be activated during a blinking period between periods during which an image is displayed by the OLED display device when the entire power source of the OLED display device is turned on.

Referring to FIG. 3, an operation of the current measurement unit 200 includes an initializing process S31, a threshold voltage storing process S32 and a current measuring process S33.

First, in the initializing process S31, the current integration circuit 210 and the threshold voltage compensation circuit 220 are initialized. As illustrated in FIGS. 4 and 5A, the current measurement control signal CSCSn becomes a high logic voltage and thus the current measurement TFT T8 is turned on to connect the OLED and the current measurement unit 200. In such an exemplary embodiment, the first switch sw1, the third switch sw3, the fifth switch sw5, the sixth switch sw6, and the feedback switch sw_fb are turned on, and the second switch sw2 and the fourth switch sw4 are turned off, such that the reference voltage Vset is applied to the current integration circuit 210 through the threshold voltage compensation circuit 220. The second input terminal (+) of the operational amplifier 211 is connected to the power supply unit 140 that supplies the reference voltage Vset through the third switch sw3, the fifth switch sw5, and the sixth switch sw6, which are turned on, and thus a voltage substantially equal to the reference voltage Vset is applied to the output terminal of the operational amplifier 211. This voltage is applied to the OLED through the feedback switch sw_fb and the first switch sw1, which are turned on, such that the OLED emits light and the current measurement unit 200 is initialized by the reference voltage Vset applied to the threshold voltage compensation circuit 220.

Subsequently, in the threshold voltage storing process S32, the threshold voltage Vth of the OLED is stored at the threshold voltage compensation circuit 220. The current measurement control signal CSCSn maintains the high logic voltage and thus the current measurement TFT T8 maintains a turned on state to connect the OLED and the current measurement unit 200. In such an exemplary embodiment, the first switch sw1, the third switch sw3, the fifth switch sw5, the sixth switch sw6, and the feedback switch sw_fb are turned off and the second switch sw2 and the fourth switch sw4 are turned on. Referring to FIG. 5B, one end of the threshold voltage storage capacitor Cvth of the threshold voltage compensation circuit 220 is connected to the OLED through the second switch sw2, which is turned on, and another end of the threshold voltage storage capacitor Cvth is connected to the ground potential through the fourth switch sw4, which is turned on. Accordingly, a voltage having a substantially same value as a value of the threshold voltage Vth of the OLED may be applied to the threshold voltage storage capacitor Cvth to be charged therein. After the voltage of the OLED reaches the threshold voltage Vth, the current measurement control signal CSCSn becomes a low logic voltage.

Subsequently, in the driving current measuring process S33, the reference voltage Vset is compensated with the threshold voltage Vth of the OLED stored in the threshold voltage compensation circuit 220, and the driving current of the OLED is measured. The current measurement control signal CSCSn becomes a high logic voltage and thus the current measurement TFT T8 is turned on to connect the OLED and the current measurement unit 200. In such an exemplary embodiment, the first switch sw1, the third switch sw3, and the sixth switch sw6 are turned on; the second switch sw2, the fourth switch sw4, and the fifth switch sw5 are turned off; and the feedback switch sw_fb is turned on and then turned off. Referring to FIG. 5C, one end of the threshold voltage storage capacitor Cvth is connected to the second input terminal (+) of the operational amplifier 211 through the third switch sw3, which is turned on, and another end of the threshold voltage storage capacitor Cvth is connected to the power supply unit 140 that applies the reference voltage Vset through the sixth switch sw6, which is turned on. In addition, the first input terminal (−) of the operational amplifier 211 is connected to the OLED through the first switch sw1, which is turned on. A substantially equal voltage is applied to the first input terminal (−) and the output terminal of the operational amplifier 211 to initialize the current integration circuit 210, and thereafter the feedback switch sw_fb is turned off. The feedback capacitor Cfb may be stored with a voltage corresponding to a current flowing through the OLED and a voltage corresponding to a leakage current. In such an exemplary embodiment, the voltage corresponding to the current flowing through the OLED and the voltage Vel corresponding to the leakage current correspond to a voltage Vset+Vth, which reflects the threshold voltage Vth of the OLED. As such, the current-voltage characteristics of the OLED may be evaluated without distortion by compensating the reference voltage Vset with the threshold voltage Vth of the OLED stored in the threshold voltage storage capacitor Cvth.

Figure 6A:
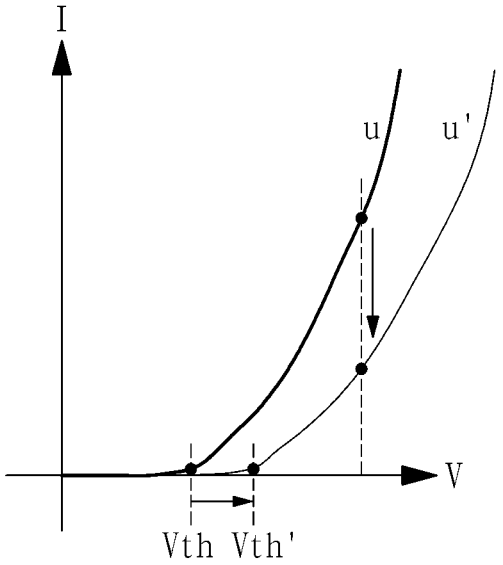
FIGS. 6A-6C are graphs illustrating current-voltage characteristics of a conventional OLED display device.
Figure 6B:
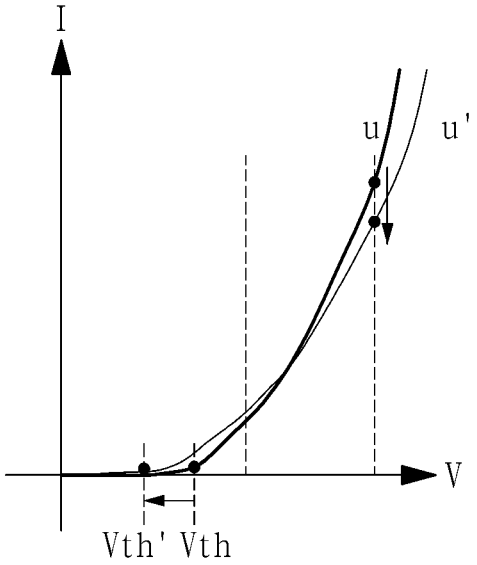
Figure 6C:
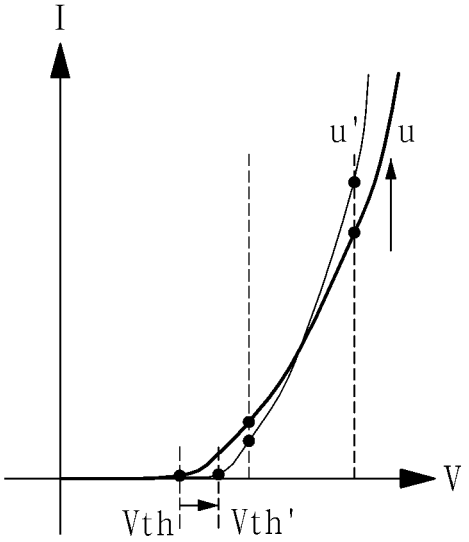
Figure 7A:
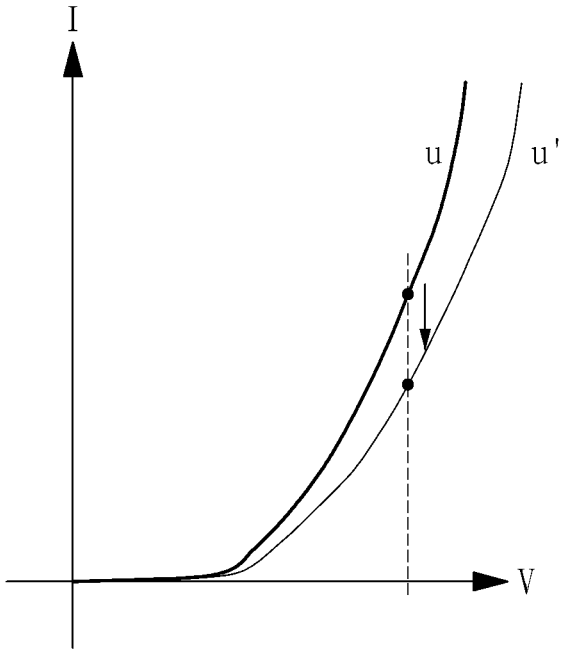
FIGS. 7A-7C are graphs illustrating current-voltage characteristics of an OLED display device according to an exemplary embodiment.
Figure 7B:
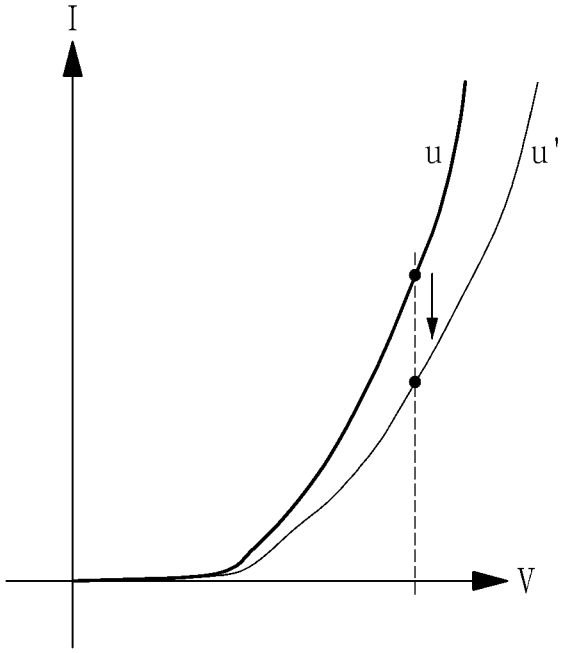
Figure 7C:
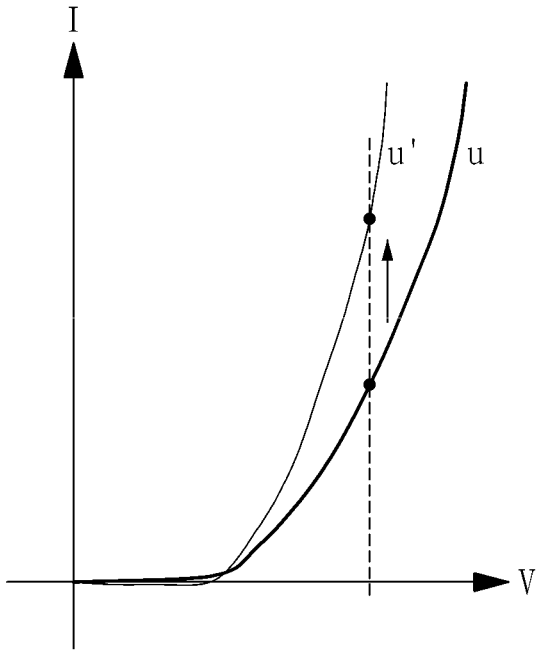

FIGS. 6A, 6B, and 6C are graphs illustrating current-voltage characteristics of a conventional OLED display device, and FIGS. 7A, 7B, and 7C are graphs illustrating current-voltage characteristics of an OLED display device according to an exemplary embodiment.

FIGS. 6A, 6B, and 6C are graphs illustrating current-voltage characteristics of an OLED of a conventional OLED display device before and after deterioration of the OLED.

FIG. 6A is a graph illustrating a case in which a mobility (u>u') of the OLED is reduced and a threshold voltage of the OLED is increased after deterioration. Referring to the graph of FIG. 6A, a direction of a change amount of a current is constant regardless of a magnitude of a reference voltage Vset.

However, FIG. 6B is a graph illustrating a case in which the mobility (u>u') of the OLED is reduced and the threshold voltage of the OLED is decreased after deterioration. Referring to the graph of FIG. 6B, a direction of a change amount of the current varies depending on the magnitude of the reference voltage Vset.

In addition, FIG. 6C is a graph illustrating a case in which the mobility (u<u') of the OLED is increased and the threshold voltage of the OLED is increased after deterioration. Referring to the graph of FIG. 6C, a direction of a change amount of the current varies depending on the magnitude of the reference voltage Vset.

That is, when the current is measured without considering the threshold voltage Vth of each pixel PX of the OLED, the current-voltage characteristics of the OLED may be distorted.

FIGS. 7A, 7B, and 7C are graphs illustrating current-voltage characteristics of an OLED of an OLED display device according to an exemplary embodiment before and after deterioration of the OLED. Referring to FIGS. 7A, 7B and 7C, it may be verified that the threshold voltage Vth of the OLED is compensated such that a direction of a change amount of a current is constant regardless of a magnitude of the reference voltage Vset.

As set forth hereinabove, according to one or more exemplary embodiments, the OLED display device and the method of driving the OLED display device may provide the following effects.

The OLED display device may compensate for deterioration in the OLED, thereby improving image quality degradation occurring in the OLED display device.

When a layer, area, or plate is referred to as being "on" another layer, area, or plate, it may be directly on the other layer, area, or plate, or intervening layers, areas, or plates may be present therebetween. Conversely, when a layer, area, or plate is referred to as being "directly on" another layer, area, or plate, intervening layers, areas, or plates may be absent therebetween. Further when a layer, area, or plate is referred to as being "below" another layer, area, or plate, it may be directly below the other layer, area, or plate, or intervening layers, areas, or plates may be present therebetween. Conversely, when a layer, area, or plate is referred to as being "directly below" another layer, area, or plate, intervening layers, areas, or plates may be absent therebetween.

The spatially relative terms "below", "beneath", "lower", "above", "upper" and the like, may be used herein for ease of description to describe the relations between one element or component and another element or component as illustrated in the drawings. It will be understood that the spatially relative terms are intended to encompass different orientations of the device in use or operation, in addition to the orientation depicted in the drawings. For example, in the case where a device illustrated in the drawing is turned over, the device positioned "below" or "beneath" another device may be placed "above" another device. Accordingly, the illustrative term "below" may include both the lower and upper positions. The device may also be oriented in the other direction and thus the spatially relative terms may be interpreted differently depending on the orientations.

Throughout the specification, when an element is referred to as being "connected" to another element, the element is "directly connected" to the other element, or "electrically connected" to the other element with one or more intervening elements interposed therebetween. It will be further understood that the terms "comprises," "comprising," "includes" and/or "including," when used in this specification, specify the presence of stated features, integers, steps, operations, elements and/or components, but do not preclude the presence or addition of one or more other features, integers, steps, operations, elements, components and/or groups thereof.

It will be understood that, although the terms "first," "second," "third," and the like may be used herein to describe various elements, these elements should not be limited by these terms. These terms are only used to distinguish one element from another element. Thus, "a first element" discussed below could be termed "a second element" or "a third element," and "a second element" and "a third element" may be termed likewise without departing from the teachings herein.

As used herein, the terms "use," "using," and "used" may be considered synonymous with the terms "utilize," "utilizing," and "utilized," respectively.

The display device and/or any other relevant devices or components according to embodiments of the present invention described herein, such as the timing controller, the scan driver, and the data driver, may be implemented utilizing any suitable hardware, firmware (e.g. an application-specific integrated circuit), software, or a suitable combination of software, firmware, and hardware. For example, the various components of the display device may be formed on one integrated circuit (IC) chip or on separate IC chips. Further, the various components of the display device may be implemented on a flexible printed circuit film, a tape carrier package (TCP), a printed circuit board (PCB), or formed on a same substrate. Further, the various components of the display device may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

While the present invention has been illustrated and described with reference to the embodiments thereof, it will be apparent to those of ordinary skill in the art that various suitable changes in form and detail may be made thereto without departing from the spirit and scope according to an embodiment.

What is claimed is:

1. An organic light emitting diode display device comprising:

a display panel comprising a pixel;

a power supply configured to apply a voltage to the pixel; and a current measurement circuit connected to the pixel, wherein the pixel comprises a pixel circuit and an organic light emitting diode, the pixel circuit comprising a plurality of switching elements and one or more capacitors, and wherein the current measurement circuit comprises:

a current integration circuit comprising an amplifier, the amplifier comprising a first input terminal, a second input terminal, and an output terminal, the first input terminal being connected to the pixel circuit;

a threshold voltage compensation circuit connected to the second input terminal of the amplifier, and configured to selectively apply a reference voltage and a sum of the reference voltage and a threshold voltage of the organic light emitting diode to the second input terminal of the amplifier;

an analog-to-digital converter connected to the output terminal of the amplifier; and wherein a current corresponding to the sum of the reference voltage and the threshold voltage is applied to the current integration circuit and the organic light emitting diode.

2. The organic light emitting diode display device of claim 1, wherein the threshold voltage compensation circuit comprises a plurality of switches and a threshold voltage storage capacitor.

3. The organic light emitting diode display device of claim 2, wherein the power supply is configured to supply the reference voltage, and the threshold voltage compensation circuit is connected to the power supply.

4. The organic light emitting diode display device of claim 3, wherein the threshold voltage compensation circuit is connected to a ground potential source.

5. The organic light emitting diode display device of claim 1, wherein the current integration circuit further comprises:

a feedback capacitor connected to the first input terminal and the output terminal of the amplifier; and a feedback switch connected in parallel with the feedback capacitor between the first input terminal and the output terminal of the amplifier.

6. The organic light emitting diode display device of claim 5, wherein the analog-to-digital converter is connected to the feedback capacitor and the feedback switch of the current integration circuit.

7. An organic light emitting diode display device comprising:

a display panel comprising a pixel;

a power supply configured to apply a voltage to the pixel; and a current measurement circuit connected to the pixel, wherein the pixel comprises a pixel circuit and an organic light emitting diode, the pixel circuit comprising a plurality of switching elements and one or more capacitors, and wherein the current measurement circuit comprises:

a current integration circuit comprising an amplifier, the amplifier comprising a first input terminal, a second input terminal, and an output terminal, the first input terminal being connected to the pixel circuit;

a threshold voltage compensation circuit connected to the second input terminal of the amplifier; and an analog-to-digital converter connected to the output terminal of the amplifier, wherein the threshold voltage compensation circuit comprises a plurality of switches and a threshold voltage storage capacitor, wherein the plurality of switches of the threshold voltage compensation circuit comprise a first switch, a second switch, a third switch, a fourth switch, a fifth switch, and a sixth switch, wherein one end of the second switch is connected to the organic light emitting diode and another end of the second switch is connected to the third switch, the threshold voltage storage capacitor, and the fifth switch, wherein one end of the third switch is connected to the second switch, the threshold voltage storage capacitor, and the fifth switch, and another end of the third switch is connected to the current integration circuit, wherein one end of the fourth switch is connected to the threshold voltage storage capacitor, the fifth switch, and the sixth switch, and another end of the fourth switch is connected to a ground potential source, wherein one end of the fifth switch is connected to the second switch, the third switch, and the threshold voltage storage capacitor, and another end of the fifth switch is connected to the fourth switch and the sixth switch, wherein one end of the sixth switch is connected to the fourth switch and the fifth switch, and another end of the sixth switch is connected to the power supply, and wherein one end of the threshold voltage storage capacitor is connected to the second switch, the third switch, and the fifth switch, and another end of the threshold voltage storage capacitor is connected to the fourth switch, the fifth switch, and the sixth switch.

8. A method of driving an organic light emitting diode display device, the method comprising:

initializing a threshold voltage compensation circuit and a current integration circuit connected to the threshold voltage compensation circuit;

storing a threshold voltage of an organic light emitting diode in the threshold voltage compensation circuit; and measuring a driving current of the organic light emitting diode by compensating a reference voltage with the stored threshold voltage of the organic light emitting diode, wherein the measuring of the driving current of the organic light emitting diode comprises:

applying a sum of the reference voltage and the stored threshold voltage to the threshold voltage compensation circuit and the organic light emitting diode.

9. The method of claim 8, wherein the initializing the threshold voltage compensation circuit comprises applying the reference voltage to the threshold voltage compensation circuit.

10. The method of claim 8, wherein the threshold voltage compensation circuit comprises a threshold voltage storage capacitor.

11. The method of claim 10, wherein the storing the threshold voltage of the organic light emitting diode in the threshold voltage compensation circuit comprises applying a threshold voltage of the organic light emitting diode to the threshold voltage storage capacitor of the threshold voltage compensation circuit.

12. The method of claim 8, wherein the reference voltage has a value greater than a value of the threshold voltage.

13. A method of driving an organic light emitting diode display device, the method comprising:

initializing a threshold voltage compensation circuit and a current integration circuit connected to the threshold voltage compensation circuit;

storing a threshold voltage of an organic light emitting diode in the threshold voltage compensation circuit; and measuring a driving current of the organic light emitting diode by compensating a reference voltage with the stored threshold voltage of the organic light emitting diode, wherein the measuring the driving current of the organic light emitting diode comprises:

applying a sum of the reference voltage and the stored threshold voltage to the threshold voltage compensation circuit and the organic light emitting diode; and applying a current corresponding to the sum of the reference voltage and the stored threshold voltage through the current integration circuit and the organic light emitting diode.

* * * * *